US006690120B2

(12) United States Patent
Oskorep et al.

(10) Patent No.: US 6,690,120 B2
(45) Date of Patent: Feb. 10, 2004

(54) YEAR-ROUND DECORATIVE LIGHTS WITH SELECTABLE HOLIDAY COLOR SCHEMES

(76) Inventors: Frank Joseph Oskorep, 690 Schooner La., Elk Grove Village, IL (US) 60007; John Jeffery Oskorep, 416 W. Briar Pl., Unit #3, Chicago, IL (US) 60657

( * ) Notice: Subject to any disclaimer, the term of this patent is extended or adjusted under 35 U.S.C. 154(b) by 61 days.

(21) Appl. No.: 10/144,149

(22) Filed: May 10, 2002

(65) Prior Publication Data

US 2003/0210547 A1 Nov. 13, 2003

(51) Int. Cl.[7] ..... H05B 35/00

(52) U.S. Cl. ..... 315/178; 315/185 R; 315/185 S; 315/292; 315/294; 362/252; 362/806

(58) Field of Search ..... 315/178, 179, 315/183, 184, 185 R, 185 S, 312, 323, 329, 362, 292–294, 297, 307, 314; 362/122, 123, 252, 391, 806

(56) References Cited

U.S. PATENT DOCUMENTS

| | | | | | |
|---|---|---|---|---|---|
| 3,623,066 | A | | 11/1971 | Norris | |
| 3,789,211 | A | | 1/1974 | Kramer | |
| 3,946,244 | A | | 3/1976 | Davis, Jr. | |
| 4,153,860 | A | * | 5/1979 | Vonick | 315/155 |
| 4,215,277 | A | | 7/1980 | Weiner et al. | |
| 4,682,079 | A | * | 7/1987 | Sanders et al. | 315/186 |
| 4,780,621 | A | | 10/1988 | Bartleucci et al. | |
| 4,890,000 | A | | 12/1989 | Chou | |
| 5,008,595 | A | | 4/1991 | Kazar | |
| 5,245,519 | A | | 9/1993 | Openiano | |
| 5,300,864 | A | | 4/1994 | Allen, Jr. | |
| 5,359,506 | A | * | 10/1994 | Koleno | 362/248 |
| 5,629,587 | A | | 5/1997 | Gray et al. | |
| 5,747,940 | A | | 5/1998 | Openiano | |
| 5,749,646 | A | | 5/1998 | Brittell | |
| 5,944,408 | A | * | 8/1999 | Tong et al. | 362/252 |
| 5,980,062 | A | | 11/1999 | Bell | |
| 6,015,218 | A | * | 1/2000 | Snell | 362/249 |
| 6,033,089 | A | | 3/2000 | Tesauro | |
| 6,050,701 | A | | 4/2000 | Stone | |
| 6,309,086 | B1 | | 10/2001 | Tomlinson | |
| 6,384,545 | B1 | | 5/2002 | Lau | |
| 6,424,096 | B1 | | 7/2002 | Lowe et al. | |

* cited by examiner

*Primary Examiner*—Haissa Philogene
(74) *Attorney, Agent, or Firm*—John J. Oskorep, Esq.

(57) ABSTRACT

A decorative light strand has user-selectable color schemes corresponding to each holiday for year-round use. The light strand has a plurality of differently colored lights; a decorating selector comprising a switch which provides a plurality of user-selectable settings; and logic coupled to the switch and the plurality of differently colored lights to provide different holiday color schemes in response to the user-selectable settings. In one specific example, the light strand includes a plurality of red lights, a plurality of white lights, a plurality of blue lights, a plurality of green lights, a plurality of orange lights, and a plurality of yellow lights. A decorating selector on one end of the light strand has a plurality of decorative holiday settings which include a New Year's holiday setting which enables the plurality of white lights; a Valentines/Sweetest Day holiday setting which enables the pluralities of red and white lights; an Independence/Memorial Day holiday setting which enables the pluralities of red, white, and blue lights; a Halloween holiday setting which enables the pluralities of orange and yellow lights; a Thanksgiving holiday setting which enables the plurality of orange and green lights; a Christmas holiday setting which enables the pluralities of red and green lights; and a Hanukkah holiday setting which enables the pluralities of blue and yellow lights. Advantageously, this light strand may be hung permanently and utilized year-round for major U.S. holidays and other suitable occasions.

47 Claims, 8 Drawing Sheets

FIG. 4

114 116

| R | Y | W | G | Bl | O | R | Y | W | G | Bl | O | R | Y | W | G | Bl | O | R | Y | W | G | Bl | O | R | Y | W | G | Bl | LED COLOR |
|---|---|---|---|---|---|---|---|---|---|---|---|---|---|---|---|---|---|---|---|---|---|---|---|---|---|---|---|---|---|
| | | | | | | | | | | | | | | | | | | | | | | | | | | | | | OFF |
| | | X | | | | | | X | | | | | | X | | | | | | X | | | | | | X | | | NEW YEAR'S/WHITE |
| X | | X | | | | X | | X | | | | X | | X | | | | X | | X | | | | X | | X | | | VALENTINES/SWEET |
| X | | X | | X | | X | | X | | X | | X | | X | | X | | X | | X | | X | | X | | X | | X | JULY4/MEMORIAL |
| | X | | | | X | | X | | | | X | | X | | | | X | | X | | | | X | | X | | | | HALLOWEEN |
| X | | | | | X | X | | | | | X | X | | | | | X | X | | | | | X | X | | | | | THANKSGIVING |
| X | | | X | | | X | | | X | | | X | | | X | | | X | | | X | | | X | | | X | | XMAS |
| | X | | | X | | | X | | | X | | | X | | | X | | | X | | | X | | | X | | | X | HANUKKAH |
| X | X | | | | | X | X | | | | | X | X | | | | | X | X | | | | | X | X | | | | PARTY 1 |
| | | X | | X | | | | X | | X | | | | X | | X | | | | X | | X | | | | X | | X | PARTY 2 |

"X" = ON

NO "X" = OFF

400

FIG. 5

TRUTH TABLE LOGIC

| Setting | Setting | RED | YELLOW | WHITE | GREEN | BLUE | ORANGE |
|---|---|---|---|---|---|---|---|
| New Year's/ White | 1 | 1 | 1 | 0 | 1 | 1 | 1 |
| Valentine's /Sweetest | 2 | 0 | 1 | 0 | 1 | 1 | 1 |
| July 4/ Memorial | 3 | 0 | 1 | 0 | 1 | 0 | 1 |
| Halloween | 4 | 1 | 0 | 1 | 1 | 1 | 0 |
| Thanks giving | 5 | 1 | 1 | 1 | 0 | 1 | 0 |
| Xmas | 6 | 0 | 1 | 1 | 0 | 1 | 1 |
| Hanukkah | 7 | 1 | 0 | 1 | 1 | 0 | 1 |
| Party 1 | 8 | 0 | 0 | 1 | 1 | 1 | 1 |
| Party 2 | 9 | 1 | 1 | 0 | 1 | 0 | 1 |
| OFF | 0 | 1 | 1 | 1 | 1 | 1 | 1 |

500

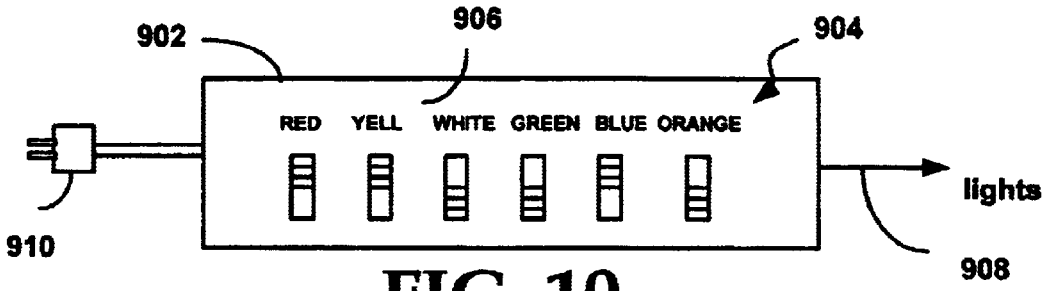
FIG. 10
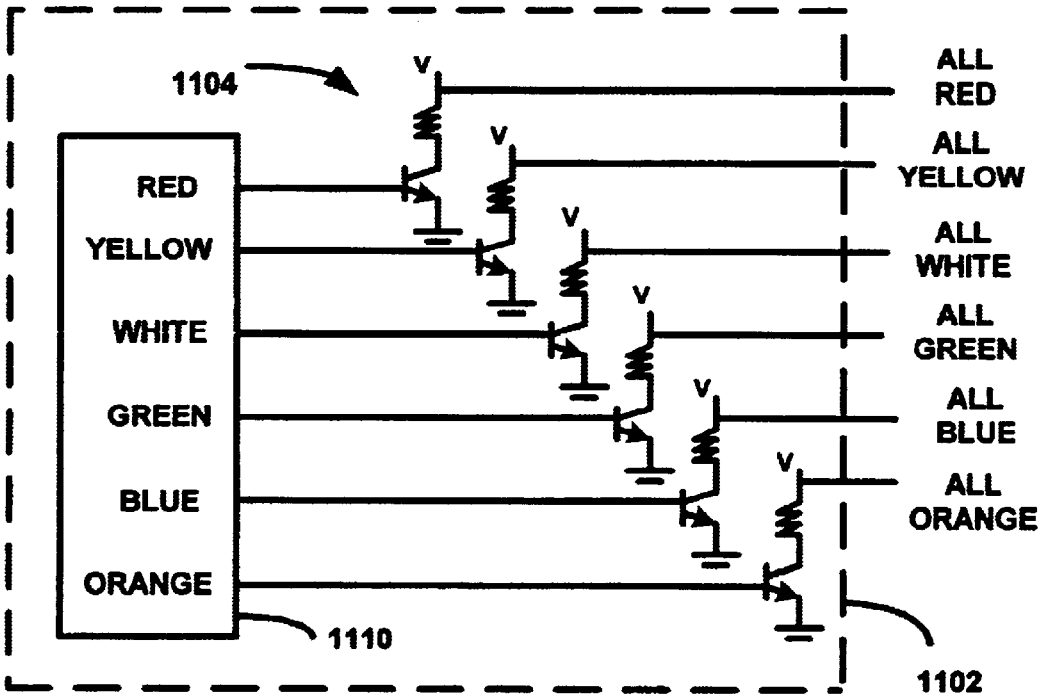
FIG. 11
FIG. 12
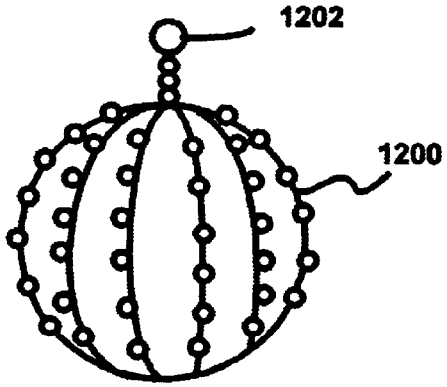

YEAR-ROUND DECORATIVE LIGHTS WITH SELECTABLE HOLIDAY COLOR SCHEMES

BACKGROUND OF THE INVENTION

1. Field of the Invention

The present invention relates generally to decorative lights such as decorative holiday lights (e.g. Christmas lights), and more particularly to decorative light strands having controls for selecting different color schemes corresponding to major holidays and other occasions.

2. Description of the Related Art

Conventional decorative lights are typically fixed in color and celebratory purpose. One type of conventional light strand includes a plurality of lights which have the same single color (e.g. all white or all red). Another conventional light strand includes a plurality of lights which are multi-colored (e.g. red, green, white, blue, and yellow) and lit all at the same time. Many of these lights are suitably colored for the Christmas holidays; e.g. solid red and green, although other multi-colored combinations are popular. Some light strands provide for a "flashing" or "blinking" of lights in a random or set fashion. An end-user of Christmas lights typically hangs one or more light strands for the holiday (indoors or outdoors), and takes them down and puts them into storage after the holiday is over.

Holidays other than Christmas are celebrated as well, although light strands for these occasions are difficult to find if they even exist at all. For Independence Day and Memorial Day, the color combination of red, white, and blue is popular. For Hanukkah, the colors of blue and gold are popular. For Halloween, the color combination of orange and yellow is popular. For these and other celebrated holidays, an individual often purchases different decorations just before the holiday and hangs them up. For other occasions, such as parties, birthdays, anniversaries, showers, graduations, etc., one typically has to purchase other suitable decorations and decorate with them. These decorative items are hung up for the occasion and thereafter taken down.

An issue with most any decorative product is that of inventory control and distribution. For light strands, there are many varieties of color schemes that are suited only to particular geographic regions (e.g. colors of state/country flag), particular regional celebrations or holidays, etc. Having such different color-schemed lighting strands for each and every different celebratory purpose or geographic region creates several different product types, making manufacturing, inventory control, and distribution difficult. The closest prior art relating to the present invention of which the inventors are aware is a Christmas light strand (manufacturer unknown) which has a button switch for providing eight (8) different lighting variations. The light strand has four (4) different colored lights in the following repeated sequence: red, green, orange, and blue. The lighting variations are described as follows: 1-"COMBINATION; 2-"IN WAVES"; 3-"TWINKLE/FLASH"; 4-"SLO-GLO"; 5-"SEQUENTIAL"; 6-"SLOW FADE"; 7-"CHASING/FLASH"; AND 8-"STEADY ON". For the $2^{nd}$, $3^{rd}$, $5^{th}$, and $7^{th}$ settings, somewhat random flashing of all of the colors are provided in subtle variations. For the $4^{th}$ and $6^{th}$ settings, fading in and out of all of the colors (in sequence and simultaneously, respectively) are provided. All colors are lit solid in the $8^{th}$ setting. Finally, the $1^{st}$ setting sequences through the $1^{st}$ through $7^{th}$ settings. This light strand and its settings are designed solely for Christmas; no different color schemes or holiday schemes are provided.

Accordingly, what is needed is a decorative lighting apparatus which overcomes the deficiencies of the prior art

SUMMARY OF THE INVENTION

Broadly, a decorative light strand has user-selectable color schemes which correspond to each major U.S. holiday for year-round use. A decorative lighting apparatus includes a light strand having a plurality of differently colored lights; a decorating selector comprising a switch which provides a plurality of user-selectable settings; and logic which selectively illuminates the plurality of differently colored lights with a different holiday color scheme for each user-selectable setting of the switch. Advantageously, these decorative lights can be hung permanently and utilized year-round for most major holidays and/or other suitable occasions.

In one illustrative example of the present invention, a light strand includes a plurality of red lights, a plurality of white lights, a plurality of blue lights, a plurality of green lights, a plurality of orange lights, and a plurality of yellow lights. A decorating selector on one end of the strand provides a plurality of decorative holiday settings which include a New Year's holiday setting which enables the plurality of white lights; a Valentines/Sweetest Day holiday setting which enables the pluralities of red and white lights; an Independence/Memorial Day holiday setting which enables the pluralities of red, white, and blue lights; a Halloween holiday setting which enables the pluralities of orange and yellow lights; a Thanksgiving holiday setting which enables the pluralities of orange and green lights; a Christmas holiday setting which enables the pluralities of red and green lights; and a Hanukkah holiday setting which enables the pluralities of blue and yellow (gold) lights.

BRIEF DESCRIPTION OF THE DRAWINGS

FIG. 4 is a color/light enabling scheme for the representative arrangement of colored lights;

FIG. 5 is a truth table for the logic utilized in the electronics of FIG. 2;

FIG. 10 is a dip switch which may be utilized for the decorating selector for selecting the colors of the lights;

FIG. 11 is a block diagram of circuitry which may be utilized for the dip switch of FIG. 10; and FIG. 12 is an alternative decorative apparatus (i.e., a decorative holiday ball) for use in connection with the present invention.

DETAILED DESCRIPTION OF THE PREFERRED EMBODIMENTS

A decorative lighting apparatus includes a light strand having a plurality of differently colored lights; a decorating selector comprising a switch which provides a plurality of user-selectable settings; and logic which selectively illuminates the plurality of differently colored lights with a different holiday color scheme for each user-selectable setting of the switch. Advantageously, these decorative lights can be permanently hung and utilized year-round for all major holidays and/or other suitable occasions. As one illustrative example, the light strand includes a plurality of red lights, a plurality of white lights, a plurality of blue lights, a plurality of green lights, a plurality of orange lights, and a plurality of gold/yellow lights. A decorating selector on one end of the strand provides a plurality of decorative holiday settings which include a New Year's holiday setting which enables the plurality of white lights; a Valentines/Sweetest Day holiday setting which enables the pluralities of red and white lights; an Independence/Memorial Day holiday setting which enables the pluralities of red, white, and blue lights; a Halloween holiday setting which enables the pluralities of orange and gold/yellow lights; a Thanksgiving holiday setting which enables the pluralities of orange and green lights; a Christmas holiday setting which enables the pluralities of red and green lights; and a Hanukkah holiday setting which enables the pluralities of blue and gold/yellow lights.

Figure 1:
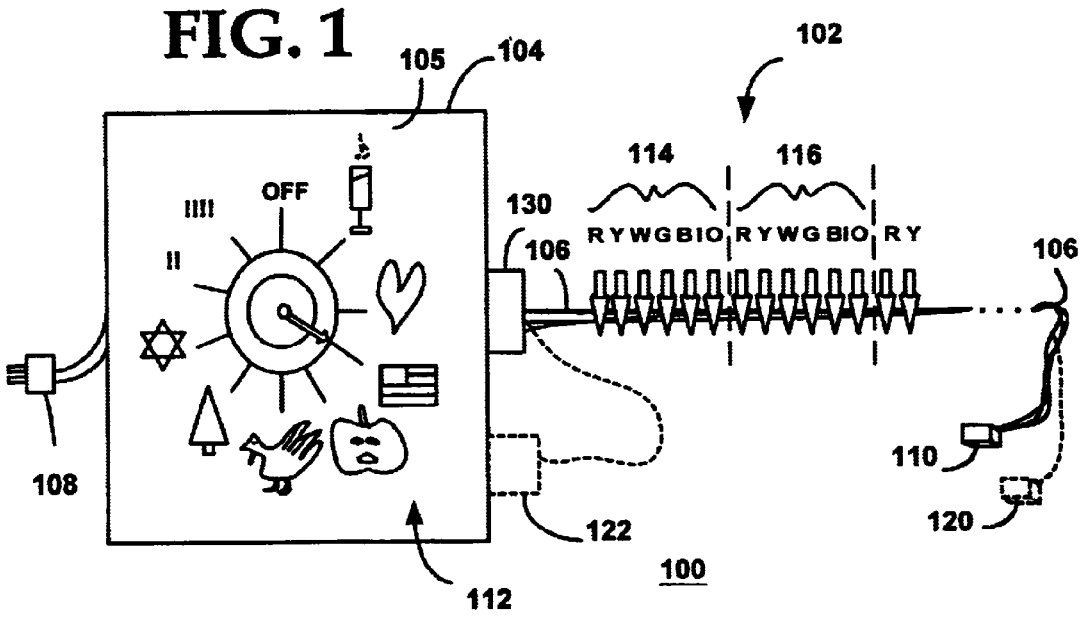
FIG. 1 is an illustration of a decorative lighting apparatus which includes a representative arrangement of colored lights and a decorating selector.

FIG. 1 is an illustration of a decorative lighting apparatus 100 which includes a representative arrangement of colored lights 102 and a decorating selector 104. Attached to decorating selector 104 is a conventional A/C power cord and plug 108 for connecting to a conventional A/C outlet for powering and illuminating colored lights 102. When decorative lighting apparatus 100 is plugged in and turned on, a plurality of wires 106 carry electrical current to light up some selected colored lights 102. Colored lights 102 may include any suitable number of different colors and, in this embodiment, colored lights 102 include six (6) colors of red (R), yellow (Y), white (W), green (G), blue (Bl), and orange (O). The light bulbs/sockets are preferably spaced relatively close to one another, for example, about 1 centimeter apart.

Colored lights 102 are positioned/sequenced by color in a predetermined manner along wires 106. In the embodiment shown in FIG. 1, the sequence is red, yellow, white, green, blue, and orange. This sequence is shown along a first light strand portion 114, which is repeated a suitable number of times along wires 106 as shown once in a second light strand portion 116.

Decorating selector 104 includes a housing 105 and a switch 112 which provides for a plurality of decorative holiday settings. In this embodiment, switch 112 is a 10-position rotary switch, single-throw. However, the number of detent positions for switch 112 may be more or less depending on how many decorative settings are desired. In an alternate embodiment, switch 112 is a conventional push-button switch which provides the plurality of different settings sequentially when pressing the button.

In this embodiment, the decorative holiday settings provided by switch 112 are provided for most major U.S. holidays. As apparent from the icons provided on housing 105 (via a plastic overlay adhesively attached on the housing), the holiday settings include (in clockwise order) a New Year's holiday setting, a Valentines/Sweetest Day holiday setting, an Independence/Memorial Day holiday setting, a Halloween holiday setting, a Thanksgiving holiday setting, a Christmas holiday setting, and a Hanukkah holiday setting. Also included are a Party-1 setting (!!) and a Party-2 setting (!!!!).

In one illustrative example, the New Year's holiday setting enables the plurality of white lights; the Valentines/Sweetest Day holiday setting enables the pluralities of red and white lights; the Independence/Memorial Day holiday setting enables the pluralities of red, white, and blue lights; the Halloween holiday setting enables the pluralities of orange and yellow lights; the Thanksgiving holiday setting enables the pluralities of orange and green lights; the Christmas holiday setting enables the pluralities of red and green lights; and the Hanukkah holiday setting enables the pluralities of blue and yellow (gold) lights. Also, the Party-1 setting enables the pluralities of red and yellow lights, and the Party-2 setting enables the pluralities of white and blue lights.

Advantageously, this strand of decorative lights can be permanently hung and utilized year-round for major holidays and/or other suitable occasions. Other suitable color schemes for each holiday may be provided; the above are merely examples. As examples, the Christmas color scheme may illuminate all of the colored lights; the Valentine's Day color scheme may illuminate red lights only; the Halloween color scheme may illuminate orange lights only or orange and white lights; etc. Also, other holidays and occasions may be provided for as well, including Easter (e.g. yellow lights; or orange and yellow lights) and St. Patrick's Day (e.g. green lights; green and white lights; or green and yellow lights).

A male connecting plug 130 is found at the front end of wires 106, and a female connecting socket 110 is found at the rear end of wires 106. Male connecting plug 130 mates with a female connecting socket provided on housing 105, which is the same type as female connecting socket 110. Female connecting socket 110 is provided so that additional colored lights of the same type may be added to the lighting strand and controlled by the same decorating selector 104.

In this embodiment, connecting plug 130 and socket 110 provide for eight (8) line connections (one control/logic line for each color, one line for A/C power, and one line for ground). With the configurations provided in FIG. 1, decorating selector 104 and colored lights 102 may be separate and independent devices and sold separately from one another. In an alternate embodiment, connecting plug 130 and socket 110 provide for only six (6) line connections (one control/logic line for each color) where lighting apparatus 100 is also equipped with a conventional A/C plug 122 and A/C socket 120 along wires 106. With this alternative approach, additional colored lights of different types may be added to the lighting strand using A/C socket 120.

Figure 2:
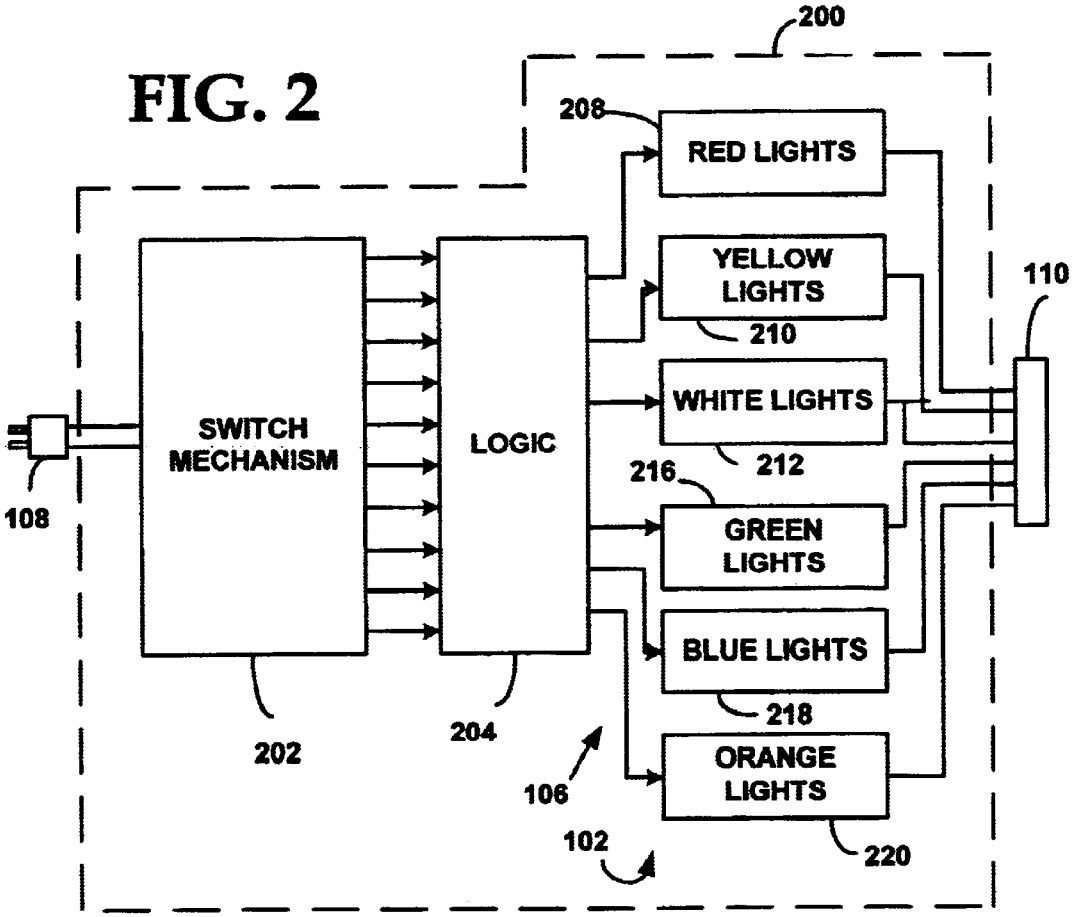
FIG. 2 is a schematic block diagram of electronics for the decorative lighting apparatus of FIG. 1.

FIG. 2 is a schematic block diagram of electronics 200 for decorative lighting apparatus 100 of FIG. 1. Electronics 200 of FIG. 2 include a switch mechanism 202, logic 204, and colored lights 102. Switch mechanism 202 has a plurality of logic outputs which change signal level based on the position of switch 112 (FIG. 1). Colored lights 102 of FIG. 2, which appear to be a single strand in FIG. 1, may actually be separately wired strands which are intertwined and include a strand of red lights 208, a strand of yellow lights 210, a strand of white lights 212, a strand of green lights 216, a strand of blue lights 218, and a strand of orange lights 220. Although each strand has a separate wire for power, they all may share the same ground wire. Each end of each separate strand of colored lights 102 is coupled to a different logic output from logic 204 so that each strand can be selectively enabled/disabled based on the position of switch 112 (FIG. 1). Logic 204 may be simple hardware gates, for example, or a microprocessor which is programmed with embedded software logic.

Figure 3A:
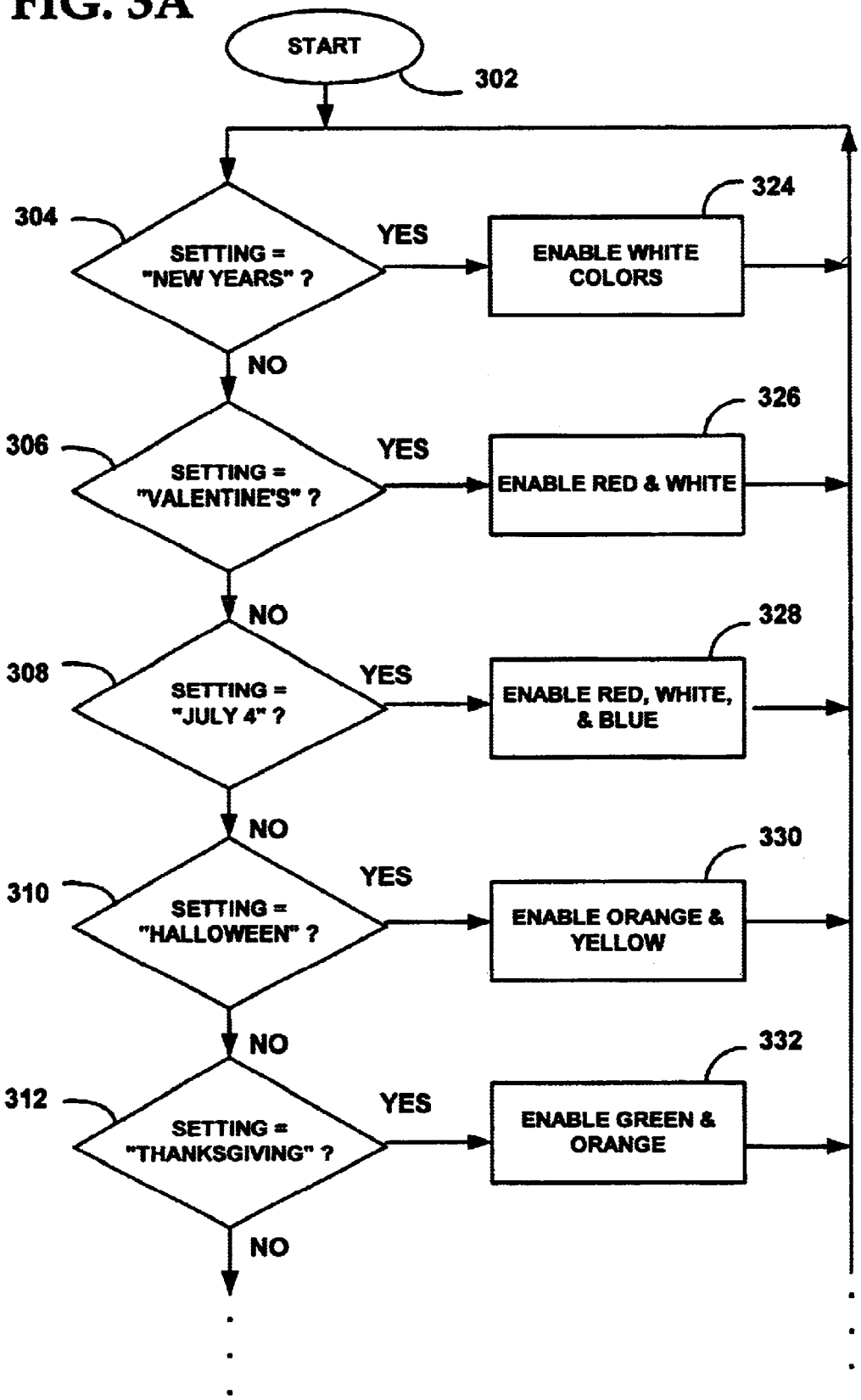
FIG. 3 is a flowchart which describes a method of selecting holiday color schemes with the decorative lighting apparatus of FIG. 1.
Figure 3B:
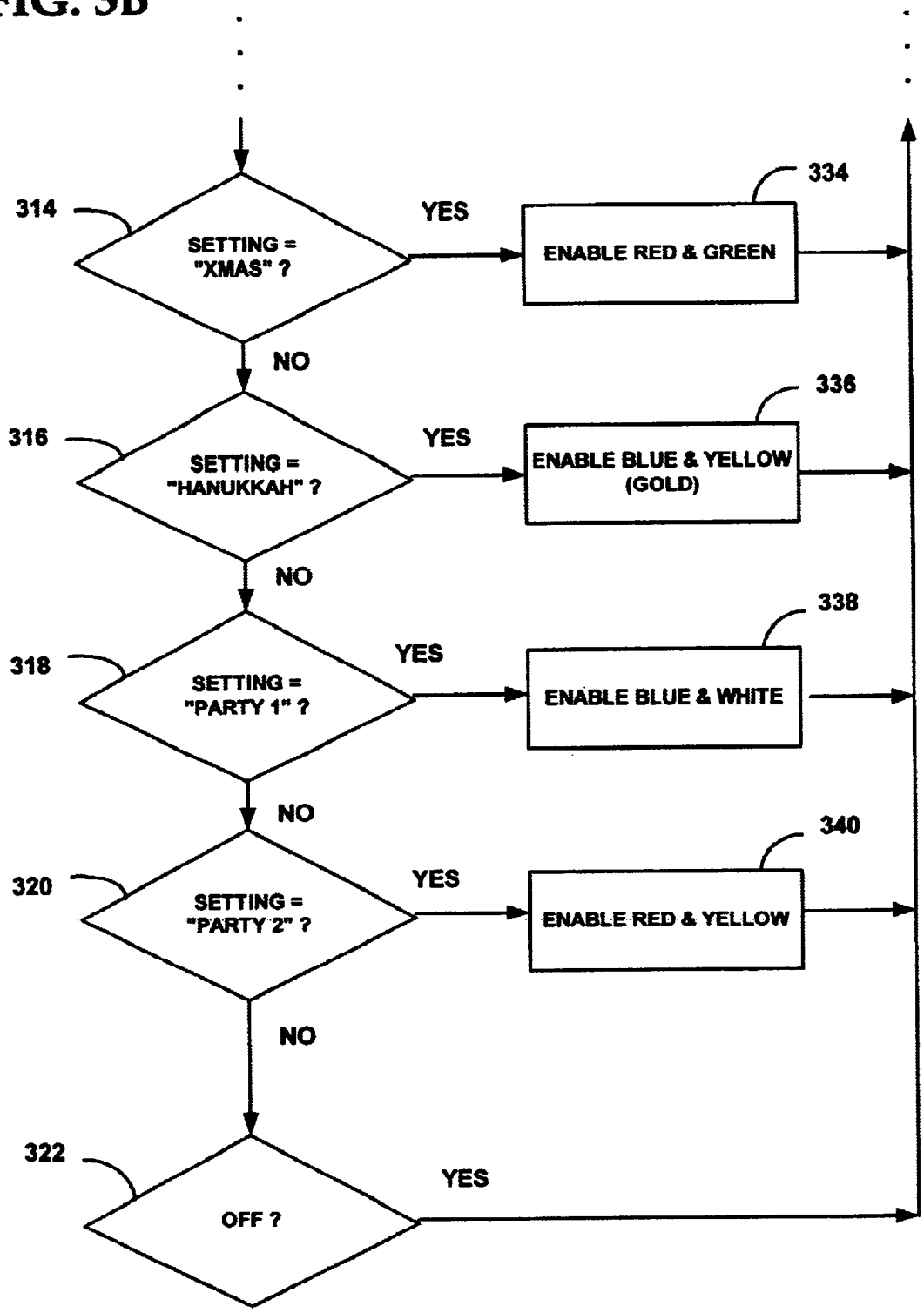

FIG. 3 is a flowchart which describes a method of selecting holiday color schemes using the decorative lighting apparatus 100 of FIG. 1. Beginning at a start block 302 in FIG. 3, if the switch setting is detected to be "New Year's" (step 304), then the logic enables the plurality of white lights only (step 324). If the switch setting is detected to be "Valentines/Sweetest Day" (step 306), then the logic enables the pluralities of red and white lights only (step 326). If the switch setting is detected to be "July 4/Memorial Day" (step 308), then the logic enables the pluralities of red, white, and blue lights only (step 328). If the switch setting is detected to be "Halloween" (step 310), then the logic enables the pluralities of orange and yellow lights only (step 330). If the switch setting is detected to be "Thanksgiving" (step 312), then the logic enables the pluralities of orange and green lights only (step 332). If the switch setting is detected to be "Christmas" (step 314), then the logic enables the pluralities of red and green lights only (step 334). If the switch setting is detected to be "Hanukkah" (step 316), then the logic enables the pluralities of blue and yellow (gold) lights only (step 336). If the switch setting is detected to be "Party-1" (step 318), then the logic enables the pluralities of red and yellow lights only (step 338). If the switch setting is detected to be "Party-2" (step 320), then the logic enables the pluralities of blue and white lights only (step 340). If the switch setting is detected to be "Off" (step 322), then no lights are enabled. The switch setting is continuously monitored so that, when set differently, the appropriate decorating lighting scheme is displayed.

FIG. 4 is a light arrangement table 400 which shows the color/light enabling scheme in the representative sequence of colored lights. Again, the representative sequence of colors shown in first and second lighting strand portions 114 and 116 is red, yellow, white, green, blue, and orange. An "X" indicates that a particular colored light is ON, whereas no "X" indicates that the particular colored light is OFF. This figure illustrates how the decorating lighting apparatus will appear when selected colors are enabled/disabled. As apparent, the sequence of colors may be important depending on the desired appearance. For example, see the appropriate spacing of colors for the "July 4$^{th}$" setting which displays red, white, and blue with a exactly single non-lit bulb space in between each lit bulb.

In FIG. 5, a truth table for the logic utilized in the electronics of FIG. 2 is shown. The logic assumes the following color-wireline order: red, yellow, white, green, blue, and orange. For the "New Year's" setting, the wired lines must be set as "110111"; for the "Valentine's" setting, the wired lines must be set as "010111"; for the "July 4" setting, the wired lines must be set as "010101"; for the "Halloween" setting, the wired lines must be set as "101110"; for the "Thanksgiving" setting, the wired lines must be set as "111010"; for the "Christmas" setting, the wired lines must be set as "011011"; for the "Hanukkah" setting, the wired lines must be set as "101101"; for the "Party-1" setting, the wired lines must be set as "001111"; for the "Party-2" setting, the wired lines must be set as "110101"; and for the "Off" setting, the wired lines must be set as "111111".

Figure 6:
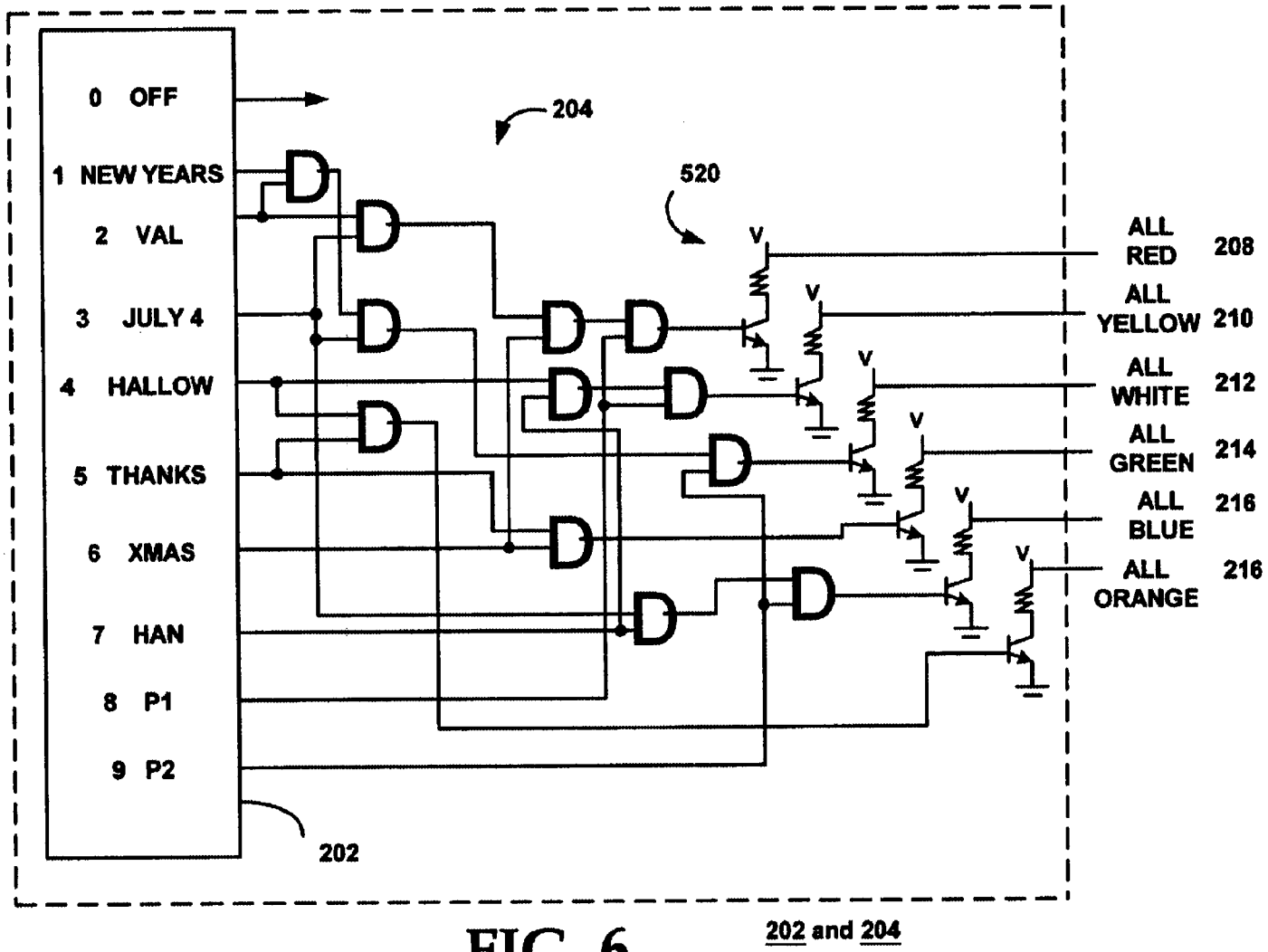
FIG. 6 is a detailed schematic diagram of the logic in the electronics of FIG. 2.

FIG. 6 is a detailed schematic diagram of the logic 204 in the electronics of FIG. 2. Switch mechanism 202 is configured such that the outputs provide the following logic: the "Off" setting=0111111111; the "New Year's" setting=1011111111; the "Valentine's" setting=1101111111; the "July 4" setting=1110111111; the "Halloween" setting=1111011111; the "Thanksgiving" setting=1111101111; the "Christmas" setting=1111110111; the "Hanukkah" setting=1111111011; the "Party-1" setting=111111101; the "Party-2" setting=1111111110. Thus, given the output logic from FIG. 5, the following relationships exist as shown in Table 1 below.

TABLE 1

Illustrative Logic.

| SWITCH OUTPUTS | COLOR STRAND ENABLE/DISABLE |
|---|---|
| 0 1 1 1 1 1 1 1 1 1 | 1 1 1 1 1 1 |
| 1 0 1 1 1 1 1 1 1 1 | 1 1 0 1 1 1 |
| 1 1 0 1 1 1 1 1 1 1 | 0 1 0 1 1 1 |
| 1 1 1 0 1 1 1 1 1 1 | 0 1 0 1 0 1 |
| 1 1 1 1 0 1 1 1 1 1 | 1 0 1 1 1 0 |
| 1 1 1 1 1 0 1 1 1 1 | 1 1 1 0 1 0 |
| 1 1 1 1 1 1 0 1 1 1 | 0 1 1 0 1 1 |
| 1 1 1 1 1 1 1 0 1 1 | 1 0 1 1 0 1 |
| 1 1 1 1 1 1 1 1 0 1 | 0 0 1 1 1 1 |
| 1 1 1 1 1 1 1 1 1 0 | 1 1 0 1 0 1 |

Logic 204 in FIG. 6 may utilize simple logic gates suitable to achieve the desired logic outputs (i.e. that shown in Table 1 above). In the embodiment shown in FIG. 6, logic 204 utilizes simple AND gates. As is apparent from the configuration of switch mechanism 202 and the logic of the AND gates, the decorative lighting apparatus will operate as previously described. In this embodiment, the colored lights are powered through switching transistors 520. However, other well-known logic and powering alternatives may be utilized. Also, as one skilled in the art will readily understand, the holiday color schemes may be enhanced by providing flickering and/or fading in and out using well-known conventional techniques.

Instead of using simple logic gates, logic 204 is alternatively a microcontroller or microprocessor programmed with embedded software to accomplish the same result. If this approach is utilized, then multiple decorative lighting strand products providing different decorative color schemes may be made using the same hardware, bulbs, and switch. The only varying aspect from product to product is the software and the plastic icon overlay utilized. In fact, the hardcoded software in read-only memory (ROM) need not be different or ever change if the microprocessor is provided or utilized with an electronically erasable/programmable ROM (EEPROM) which may be flexibly programmed and/or pre-programmed with suitable bit masks (e.g., see table 500 in FIG. 5) from product to product for selecting which colors should be lit. This alternative approach is particularly advantageous so that a variety of different product lines that differ only by software (or programmed EEPROM data) and plastic icon overlay may be easily manufactured. Thus, the logic used may be a controller, a processor, logic gates, or combinations thereof.

Figure 7:
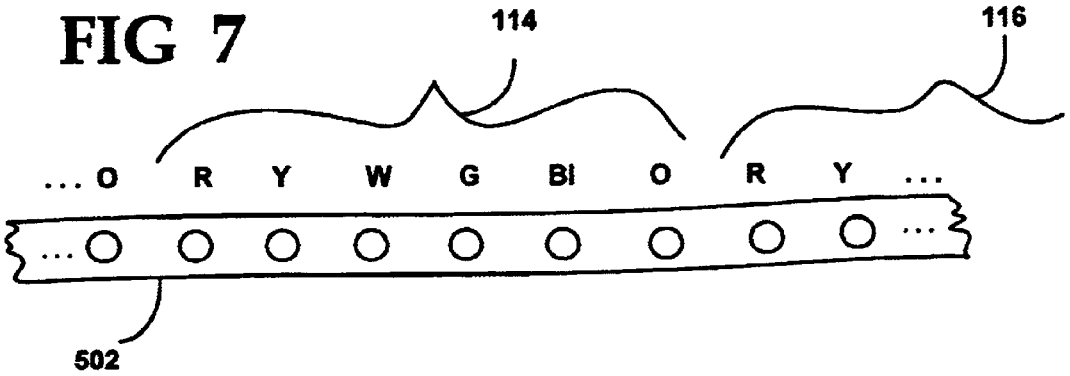
FIG. 7 is a particular embodiment where the light strand is embodied in a flexible translucent rope or tube.

FIG. 7 is an embodiment where the light strands of decorative lighting apparatus 100 of FIG. 1 are embodied in a flexible translucent rope 502 which may be made of plastic. Such rope 502 is conventionally employed in what is referred to as a "rope light", for example the Duralight Ropelight which may be obtained from DFB Sound & Light Warehouse Ltd in the United Kingdom. Containment of the bulbs and wires within such a conventional flexible translucent rope is preferable since the wires and non-lit bulbs are not readily visible.

Figure 8:
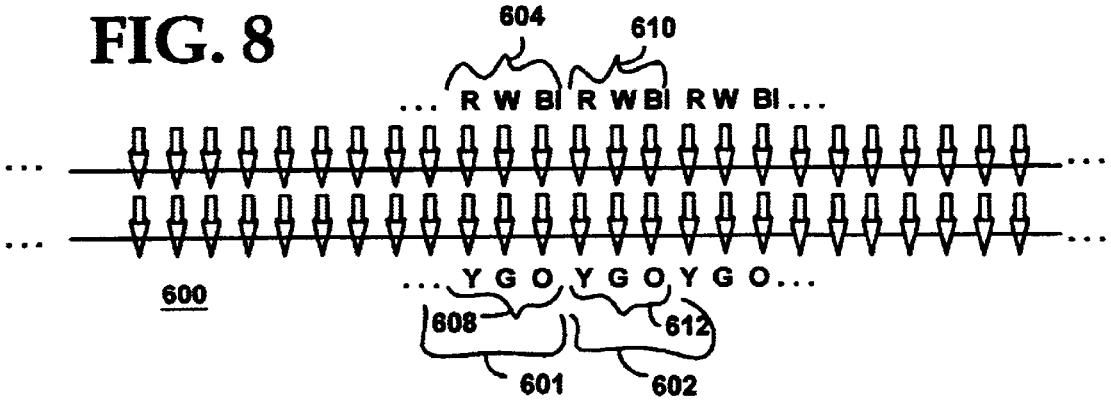
FIG. 8 is an alternative arrangement of the lights where two rows of lights are positioned side by side.
Figure 9:
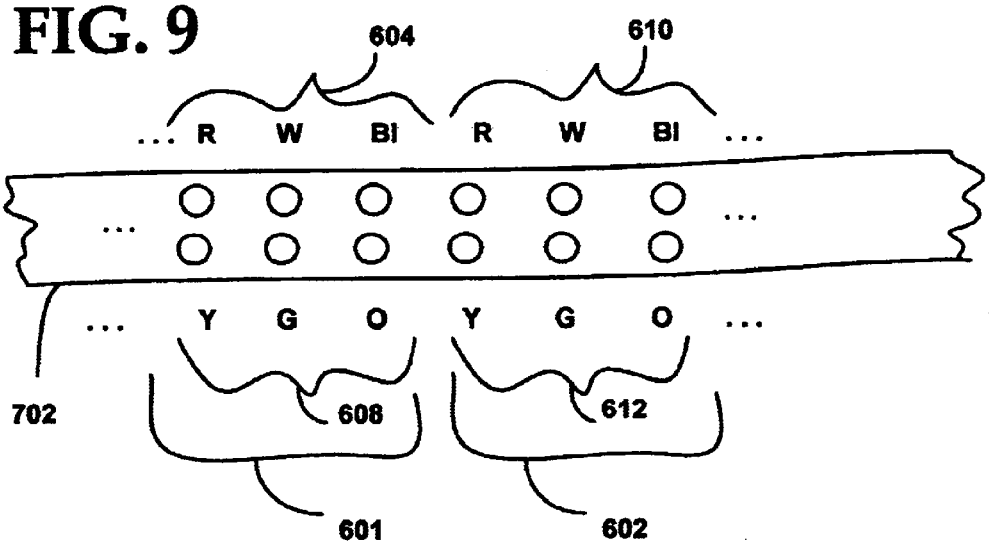
FIG. 9 is the alternative arrangement of FIG. 8 embodied in a flexible translucent rope or tube.

FIG. 8 is an alternative arrangement of the lights where two rows of lights are positioned side by side. A first light strand portion 601 includes a first row strand 604 having a first set of colors and a second row strand 608 having a second set of colors different from the first set. In this embodiment, the first set of colors of first row strand 604 are red, white, and blue, and are ordered in that manner as well. The second set of colors of second row strand 608 are yellow, green, and orange, and are ordered in that manner. FIG. 9 is the alternative arrangement of FIG. 8 embodied in a flexible translucent rope 702 ("rope lights"). The arrangement of FIGS. 8 and 9 may be preferable if even closer spacing between bulbs is desired.

FIG. 10 is a different configuration where an alternative switch 902 is utilized for the decorating selector 104 of FIG. 1 for selecting the colors of the lights. In this embodiment, switch 902 is actually a dip switch which provides for the selection of specific colors to be turned on/off. A housing 906 carries the dip switch; an A/C power plug 910 is connected to housing 906 as are light strands 908. The decorative lighting apparatus in this embodiment otherwise has similar structure and functionality as that described in relation to FIGS. 1–2 and 7–9. FIG. 11 is a block diagram of circuitry 1102 which may be utilized for the dip switch of FIG. 10. Switch mechanism 1110 has logic outputs for each color, where each output is a '1' for off and a '0' for on. In this embodiment, the colored lights are powered through switching transistors 1104. However, other suitable powering alternatives may be utilized. Decorative outcomes similar to those described in relation to FIGS. 1–6 may be achieved utilizing this dip switch technique, but where the end-user has complete control over each color.

As an added feature, the light strand arrangements described herein may utilize a wireless remote control device for selecting one of the desired color schemes. In this case, a wireless receiver with antenna is coupled to the logic for receiving the wireless signal and control command from the wireless remote control device and thereafter setting the outputs to configure the appropriate color scheme.

FIG. 12 is an alternate embodiment of a decorative lighting apparatus of the present invention. More particularly, FIG. 12 shows a decorative holiday ball 1200 which may be hung from a ceiling by an attachment 1202 (e.g., a chain or rope). In this embodiment, the decorative holiday ball 1200 is made from a skeletal structure of light-weight metal which is formed into a sphere. This sphere is decorated with lights, and could be decorated with other decorative materials such as decorative paper, streamers, etc. Ball 1200 is configured to function in the same manner as that described in relation to FIGS. 1–11 and is selectively illuminated with a different holiday color scheme based on the user-selectable setting. Each separate vertical strand on the sphere may have the same light color sequence as the others. Alternatively, every other strand may have the same color sequences when the two different colored strands shown and described in relation to FIG. 8 are used.

As another variation to that described in relation to FIGS. 1–11, each separate color strand does not need not be intertwined with the others such that the different colored bulbs are interleaved, but rather each color strand can be placed adjacent to one another such that the different colored bulbs are side-by-side to form a decorative 2-dimensional plane.

It is to be understood that the above is merely a description of preferred embodiments of the invention and that various changes, alterations, and variations may be made without departing from the true spirit and scope of the invention as set for in the appended claims. The particular color schemes for the holidays described herein are merely examples and may vary. Also, instead of providing U.S. holiday schemes, the settings may be suitable to provide a plurality of different geographical regional color schemes such as different flag colors for different states or countries (France, Germany, Italy, etc.) or different holiday schemes for non-U.S. country. Alternatively, the settings may provide color schemes which correspond to a plurality of different sports teams such as different football teams (Chicago Bears, New York Giants, San Diego Chargers, etc.), baseball teams, soccer teams, hockey teams, etc. None of the terms or phrases in the specification and claims has been given any special particular meaning different from the plain language meaning to those skilled in the art, and therefore the specification is not to be used to define terms in an unduly narrow sense.

What is claimed is:

1. A decorative lighting apparatus, comprising:

a light strand having a plurality of lights;

a decorating selector comprising a switch which provides a plurality of user-selectable settings; and logic which selectively illuminates the plurality of lights with a different holiday color scheme for each user-selectable setting of the switch.

2. The decorative lighting apparatus of claim 1, wherein the decorative lighting apparatus has a Christmas color scheme and a national flag color scheme.

3. The decorative lighting apparatus of claim 1, wherein the decorative lighting apparatus has a Christmas color scheme which illuminates at least red and green colors and an Independence Day color scheme which illuminates red, white, and blue colors.

4. The decorative lighting apparatus of claim 1, wherein the decorative lighting apparatus has a Christmas color scheme, a New Year's color scheme, and a national flag color scheme.

5. The decorative lighting apparatus of claim 1, further comprising:

a flexible translucent rope; and the plurality of differently colored lights disposed within the flexible translucent rope.

6. The decorative lighting apparatus of claim 1, further comprising:

a connecting socket coupled to one end of the light strand and adapted to receive a connecting plug from another light strand for control by the decorating selector.

7. The decorative lighting apparatus of claim 1, wherein the logic comprises one of a controller, a processor, and logic gates.

8. The decorative lighting apparatus of claim 1, wherein the decorating selector comprises one of a rotary switch, a wireless switch, and a push-button switch.

9. The decorative lighting apparatus of claim 1, wherein the decorative lighting apparatus provides at least three different holiday color schemes.

10. The decorative lighting apparatus of claim 1, further comprising:

wherein the decorative lighting apparatus has at least three different holiday color schemes;

the at least three different holiday color schemes including:

a Christmas holiday color scheme;

a national flag color scheme; and wherein the national flag color scheme comprises a selective illumination of three different flag colors, each flag color illuminated in the national flag color scheme being spaced equally apart from each adjacent flag color illuminated in the national flag color scheme.

11. The decorative lighting apparatus of claim 1, further comprising:

wherein the light strand comprises a plurality of independently illuminable light strands which are intertwined together in a linear fashion to form the light strand;

wherein the lights provide at least four different light colors along the light strand;

wherein the lights are in a repeated fixed color sequence along the light strand;

wherein the decorating selector includes a plurality of visual holiday indicators for each user-selectable setting of the switch; and wherein the decorative lighting apparatus has at least three different holiday color schemes.

12. The decorative lighting apparatus of claim 1, further comprising:

an alternating current (AC) plug on one end of the light strand for electrically powering the lights;

wherein the decorating selector includes a plurality of visual holiday indicators for each user-selectable setting of the switch; and wherein the decorative lighting apparatus has at least a Christmas holiday color scheme, an Independence Day holiday color scheme, a Valentine's Day holiday color scheme, and a St. Patrick's Day holiday color scheme.

13. The decorative lighting apparatus of claim 1, further comprising:

the logic comprising a microprocessor;

microprocessor instructions programmed in the microprocessor for:

reading each user-selectable setting of the switch; and providing an output for the selective illumination of the plurality of lights.

14. The decorative lighting apparatus of claim 1, wherein the light strand is formed as a single linear strand along which the plurality of lights are positioned.

15. The decorative lighting apparatus of claim 1, wherein the different holiday color schemes include a Christmas holiday color scheme, a St. Patrick's Day holiday color scheme, and a Valentine's day holiday color scheme.

16. A decorative lighting apparatus, comprising:

a light strand having a plurality of lights;

a decorating selector comprising a switch which provides a plurality of user-selectable settings;

logic which selectively illuminates the light strand with a different color scheme for each user-selectable setting of the switch; and each color scheme comprising at least two colors.

17. The decorative lighting apparatus of claim 16, further comprising:

a flexible translucent rope; and the colored lights being disposed in the flexible translucent rope.

18. The decorative lighting apparatus of claim 16, wherein the different color schemes are associated with and correspond to different U.S. holidays.

19. The decorative lighting apparatus of claim 16, wherein the different color schemes are associated with and correspond to most major U.S. holidays.

20. The decorative lighting apparatus of claim 16, wherein the different color schemes are associated with and correspond to different U.S. holidays including Christmas and Independence Day.

21. The decorative lighting apparatus of claim 16, wherein the different color schemes are associated with and correspond to different U.S. holidays including New Year's Day, Independence/Memorial Day, and Christmas.

22. The decorative lighting apparatus of claim 16, wherein the different color schemes are associated with and correspond to different country/state flags.

23. The decorative lighting apparatus of claim 16, wherein the different color schemes are associated with and correspond to different sports teams.

24. The decorative lighting apparatus of claim 16, wherein the logic comprises one of a controller, a processor, and logic gates.

25. The decorative lighting apparatus of claim 16, wherein the decorating selector comprises one of a rotary switch, a push-button switch, a wireless switch, and one or more dip switches.

26. A method of providing a decorative lighting apparatus with a plurality of different color schemes, comprising the acts of:

providing for a selective illumination of light colors in the decorative lighting apparatus in accordance with a Christmas holiday color scheme, in response to a first user switch setting of the decorative lighting apparatus; and providing for a selective illumination of light colors in the decorating lighting apparatus in accordance with a national flag color scheme, in response to a second user switch setting of the decorative lighting apparatus.

27. The method of claim 26, wherein the decorative lighting apparatus comprises a plurality of lights along a light strand.

28. The method of claim 27, wherein the national flag color scheme comprises a selective illumination of three different flag colors, each flag color illuminated in the national flag color scheme being spaced equally apart from each adjacent flag color illuminated in the national flag color scheme.

29. The method of claim 28, wherein the national holiday color scheme consists of the colors red, white, and blue.

30. The method of claim 26, comprising the further act of:

providing for a selective illumination of one or more light colors in the decorative lighting apparatus in accordance with a New Year's holiday color scheme, in response to a third user switch setting of the decorative lighting apparatus.

31. The method of claim 26, comprising the further act of:

A providing for a selective illumination of one or more light colors in the decorative lighting apparatus in accordance with an Easter holiday color scheme, in response to a third user switch setting of the decorative lighting apparatus.

32. The method of claim 31, further comprising:

wherein the Christmas holiday color scheme includes the colors red and green; and wherein the Easter holiday color scheme includes the color yellow.

33. The method of claim 26, wherein the national flag color scheme includes at least the colors of red and white, the method comprising the further act of:

providing for a selective illumination of one or more light colors in the decorative lighting apparatus in accordance with a Valentine's Day holiday color scheme, in response to a third user switch setting of the decorative lighting apparatus.

34. The method of claim 26, wherein the national flag color scheme includes at least the colors of red and white, the method comprising the further act of:

providing for a selective illumination of one or more light colors in the decorative lighting apparatus in accordance with a St. Patrick's Day holiday color scheme, in response to a third user switch setting of the decorative lighting apparatus.

35. A method of providing a decorative lighting apparatus with a plurality of different holiday color schemes, comprising the acts of:

providing for a selective illumination of one or more light colors in the decorative lighting apparatus in accordance with a New Year's color scheme, in response to a first user switch setting of the decorative lighting apparatus;

providing for a selective illumination of light colors in the decorative lighting apparatus in accordance with an Easter holiday color scheme, in response to a second user switch setting of the decorative lighting apparatus;

providing for a selective illumination of one or more light colors in the decorative lighting apparatus in accordance with a national flag color scheme, in response to a third user switch setting of the decorative lighting apparatus; and providing for a selective illumination of light colors in the decorating lighting apparatus in accordance with a Christmas holiday color scheme, in response to a fourth user switch setting of the decorative lighting apparatus.

36. The method of claim 35, further comprising:

wherein the Christmas color scheme includes at least the color red; and wherein the Easter color scheme includes at least the color yellow.

37. The method of claim 35, comprising the further acts of:

providing a selective illumination of one or more light colors in the decorative lighting apparatus in accordance with a St. Patrick's Day holiday color scheme, in response to a fifth user switch setting of the decorative lighting apparatus.

38. The method of claim 35, comprising the further acts of:

providing for a selective illumination of one or more light colors in the decorative lighting apparatus in accordance with a Valentine's Day holiday color scheme, in response to a fifth user switch setting of the decorative lighting apparatus.

39. A decorative lighting apparatus, comprising:

at least four light strands;

an alternating current (AC) plug for supplying electrical power to the at least four light strands;

the at least four light strands including:

a first light strand which provides for an illumination of a first plurality of lights with a red color;

a second light strand which provides for an illumination of a second plurality of lights with a white color;

a third light strand which provides for an illumination of a third plurality of lights with a blue color;

a fourth light strand which provides for an illumination of a fourth plurality of lights with a green color;

a decorating selector comprising a switch which provides a plurality of user-selectable settings for the decorative lighting apparatus and a different color scheme in the lights for each user-selectable setting;

the different color schemes comprising:

a first color scheme consisting of the colors red, white, and blue;

a second color scheme consisting of the color white; and a third color scheme including the colors red and green.

40. The decorative lighting apparatus of claim 39, wherein the at least four light strands are intertwined together in a linear fashion to form a fixed repeated light color sequence.

41. The decorative lighting apparatus of claim 39, further comprising:

a fourth color scheme including the color red but not green; and a fifth color scheme including the color green but not red.

42. The decorative lighting apparatus of claim 39, further comprising:

wherein the at least four light strands include a fifth light strand which provides for an illumination of a fifth plurality of lights with an orange color; and wherein a fifth color scheme of the decorative lighting apparatus includes the color orange.

43. A decorative lighting apparatus, comprising:

a light strand having a plurality of differently colored lights;

a plurality of user-settable switches; and a plurality of outputs which selectively configure the light strand with a different color scheme based on the settings of the plurality of user-settable switches.

44. The decorative lighting apparatus of claim 43, further comprising:

a flexible translucent rope; and the different colored lights being disposed in the flexible translucent rope.

45. The decorative lighting apparatus of claim 43, wherein the plurality of user-settable switches comprise dip switches.

46. The decorative lighting apparatus of claim 43, wherein each color scheme comprises at least two colors.

47. The decorative lighting apparatus of claim 43, wherein the different color schemes include a Christmas holiday color scheme, a St. Patrick's Day holiday color scheme, and a Valentine's day holiday color scheme.

* * * * *